United States Patent [19]

Morrison et al.

[11] 4,198,778

[45] Apr. 22, 1980

[54] AMUSEMENT DEVICE

[75] Inventors: Howard J. Morrison, Deerfield; Donald K. Fletchic, Rolling Meadows, both of Ill.

[73] Assignee: Marvin Glass & Associates, Chicago, Ill.

[21] Appl. No.: 886,997

[22] Filed: Mar. 16, 1978

[51] Int. Cl.[2] ..... A63H 33/00

[52] U.S. Cl. ..... 46/4; 46/2; 273/123 R

[58] Field of Search ..... 46/2, 3, 4, 5; 273/119 R, 123 R, 144 R, 144 A

[56] References Cited

U.S. PATENT DOCUMENTS

| | | | |
|---|---|---|---|
| 495,734 | 4/1893 | Haydon et al. | 46/4 |
| 704,239 | 7/1902 | Crannell | 46/4 |
| 2,083,119 | 6/1937 | Hense | 273/119 R |
| 2,966,003 | 12/1960 | Kreiss | 46/4 |
| 3,295,247 | 1/1967 | Lerner | 46/4 |
| 3,448,982 | 6/1969 | Griggs | 273/123 R |

*Primary Examiner*—Russell R. Kinsey
*Assistant Examiner*—Mickey Yu
*Attorney, Agent, or Firm*—Mason, Kolehmainen, Rathburn & Wyss

[57] ABSTRACT

A toy bank includes a generally cylindrical, transparent upper housing portion having a slot therein for receiving tokens such as money or the like. A lower storage cavity or housing portion is defined by a shell and a transverse, generally upwardly directed concave surface having at least one aperture therein in communication with the upper housing portion. A manually operable propulsion device mounted on the transverse surface engages the token for directing the tokens through the aperture into the lower housing portion. The propulsion means includes a hand crank connected by a gear train to a propeller having its blades extending upwardly through the transverse surface to engage and deposit the tokens in the lower housing portion.

17 Claims, 3 Drawing Figures

AMUSEMENT DEVICE

BACKGROUND OF THE INVENTION

1. Field of the Invention

The present invention relates to amusement devices and in particular to a bank-type amusement device.

2. Brief Description of the Prior Art

Toy banks which encourage children, as well as adults, to save money, have been known for many years. Typically, such banks are in the form an shape of animals such as the common "piggybank" but, of course, may take any form. Most banks of this type are sculptured and decorated in order to be attractive to children and thus inspire thriftiness and encourage their use.

In addition, many banks have been provided which will provide an amusing or entertaining course of travel for the coins which have been deposited in the bank.

SUMMARY OF THE INVENTION

The object of the present invention is to provide a new and improved amusement device in the form of a toy bank in which a propulsion means engages tokens or coins deposited therein and directs the tokens to a storage compartment.

A bank made in accordance with the above and other objects of the present invention includes the provision of a generally cylindrical, transparent upper housing portion having a depository means in the form of a slot therein for receiving tokens such as money or the like. A lower housing portion is defined by a cup-shaped shell and a transverse, generally horizontal, upwardly directed concave surface having at least one aperture therein. A propulsion device mounted on the transverse surface is manually operable to engage and direct the tokens through the aperture into the lower housing portion. The propulsion means includes a hand crank connected through a gear train to a propeller having its blades extending upwardly through the transverse surface which engages the tokens and propels them through the aperture into the lower housing portion.

DETAILED DESCRIPTION OF THE PREFERRED EMBODIMENT

Figure 1:
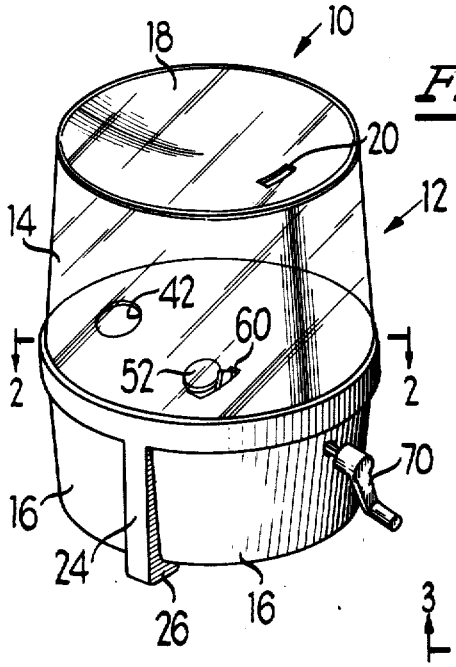
FIG. 1 is a perspective view of the toy bank made in accordance with the concepts of the present invention.
Figure 3:
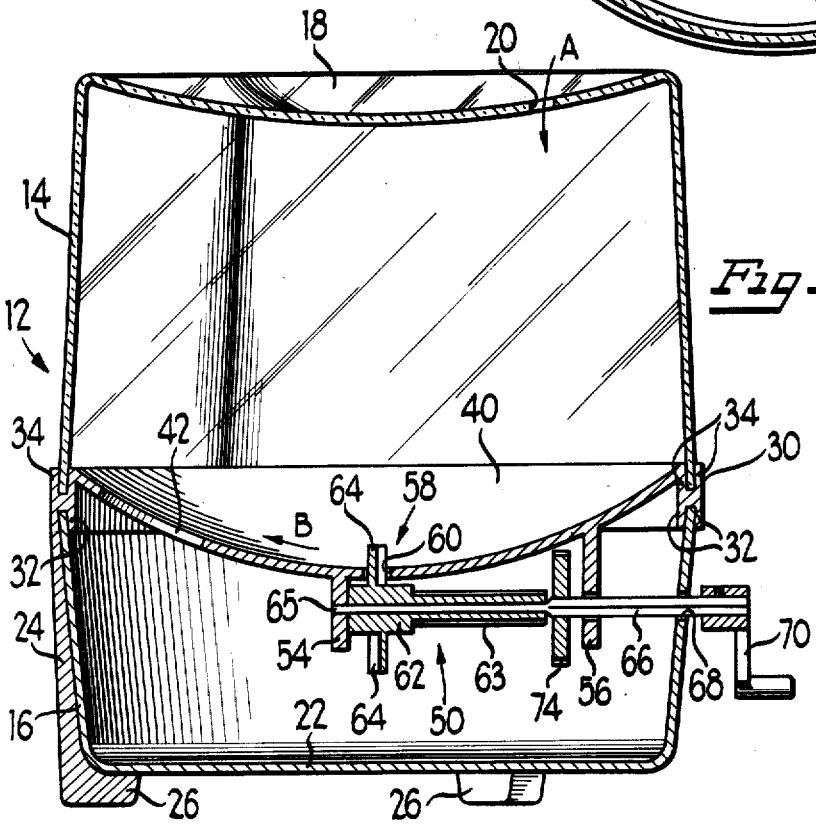
FIG. 3 is a vertical section of the toy bank taken generally along line 3—3 of FIG. 2.

A toy bank made in accordance with the concepts of the present invention is shown in FIG. 1 and generally designated by the reference numeral 10. Referring to FIGS. 1 and 3, the toy bank 10 includes a housing, generally designated 12, having an upper housing portion 14 which, as shown in the preferred embodiment, is made of clear transparent material and a lower housing portion 16 made of opaque material. The housing portions 14 and 16 are generally cylindrical in shape but tapering slightly outwardly from the top and bottom, respectively. The top 18 of the upper housing portion 14 is generally concave in shape as shown in FIG. 3 and includes a depository means or slot 20 through which coins or other tokens may be deposited or dropped generally in the direction of arrow A as shown. The lower housing portion 16 includes a generally flat circular base 22 and a plurality of flanges 24 around the outer periphery which terminate in legs or feet 26 as shown in FIG. 3, which support the bottom 22 of the bank off of a suitable supporting surface. The flanged legs 26 may be integrally molded with the lower housing portion 16 or secured to the exterior by suitable adhesive means such as glue or the like.

Connection means 30 in the form of a circular H-shaped flange are provided to connect the upper and lower housing portions. More particularly, the connection means 30 includes a pair of downwardly directed flanges 32 which seat within the upper edge of the housing 14 and a pair of upwardly directed flanges 34 which provide a circular slot or groove for the upper housing portion 14. The slot provided by the flanges 32 and 34 may be press-fit to maintain the housing portions as a single unit or, may be used in conjunction with a suitable adhesive to connect these elements together.

A generally transverse housing divider or wall 40 is connected to or integrally molded with the inner flange 34 to provide a divider wall between the upper and lower housing portions 14 and 16, respectively. At least one aperture 42 is provided in the wall 40 to communicate between the volume within the upper housing portion and that within the lower housing portion. Preferably, the wall 40 is generally concave, as shown in FIG. 3, and the aperture 42 is provided upwardly along the wall as shown in FIG. 3. The aperture 42 is sized to accept various size coins or tokens such as quarters, half dollars and other tokens such as smaller coins.

Figure 2:
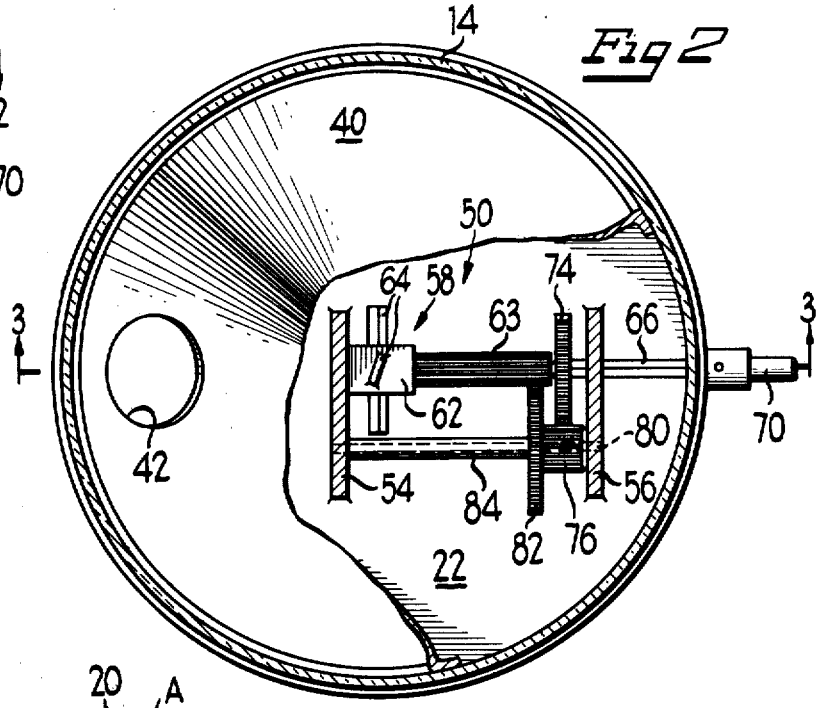
FIG. 2 is a fragmentary, horizontal section, on an enlarged scale, taken generally along line 2—2 of FIG. 1.

A propulsion means, generally designated 50 (FIGS. 2 and 3), is provided to propel tokens or coins such as the token 52 in FIG. 1 through the aperture 42 for storage in the lower housing portion 16. The coins or tokens 52 are deposited through the slot 20 and fall onto the concave surface 40 generally at the lowermost point thereof, as shown in FIG. 1. The propulsion means 50 will engage the token 52 causing it to move upwardly along the surface 40, generally in the direction of arrow B and through the aperture 42 into the storage compartment therebelow.

The propulsion means 50 is mounted to the lower side of the surface 40 by a pair of downwardly extending flanges 54 and 56 which may be integrally molded thereiwth. Means in the form of a propeller, generally designated 58, extends through a slot or aperture 60 at the low point of the concave surface 40 for propelling the tokens 52. The means 58 includes a propeller hub 62 having four blades 64 angled as shown so that rotation in a counterclockwise direction, as viewed from the left, caused the tokens 52 to be impinged by the portion of the blades 64 which extend through the aperture 60.

The hub 62 is secured to a splined shaft 63 and mounted for rotation through a central longitudinal bore by a shaft 65 rotatably mounted at its left end in the flange 54. The shaft 65 is conjointly rotatably mounted, or integrally molded, with a square shaft 66 which passes through an aperture in the flange 56 and through an aperture 68 in the side wall of the housing 16. A crank arm 70 is secured to the exposed end of the square shaft portion 66 by a set screw or similar attachment means. A first gear 74 is secured to the square shaft adjacent the splined shaft 63 for rotation as the crank 70 is manually rotated by the user. The gear 74 engages a pinion gear 76 rotatably mounted by an offset shaft 80 within the flanges 54 and 56. The pinion gear 76 is connected to a second gear 82 mounted on the same shaft 80 for conjoint rotation therewith. A tubular portion or spacer 84 between the gear 82 and the flange 54 locates the gear 82 for driving engagement with the splined shaft 63. Therefore, manual rotation of the gear 74 through the pinion gear 76 and second gear 82 drives the splined shaft 63 at a substantially higher rate of rotation. Typically, the stepup in rate of rotation between the crank 70 and the propeller 58 is in the range of 10 to 1. It can be seen from the above description and drawings that the shaft 65 rotates at a substantially slower rate, but in the same direction as the splined shaft 63 and the propeller 58.

The rapid rotation of the blades 64 will impart significant forces to the tokens 52. However, not necessarily every contact or launching of a token 52 will result in the token falling through the aperture 42 into the storage compartment. However, due to the concave nature of the surface 40, any misshots will result in the token returning back to engage one or the other sides of the blades 64 for additional movement within the upper chamber for eventual travel through the aperture 42 and into the storage compartment therebelow. A friction fit of the lower housing 16 within the flanges 32 will permit easy opening of the storage compartment defined thereby for removal of the tokens or coins for future use.

The foregoing detailed description has been given for clearness of understanding only and no unnecessary limitations should be understood therefrom as some modifications will be obvious to those skilled in the art.

We claim:

1. A toy bank, comprising:

a transparent upper housing portion;

means for receiving tokens, such as money or the like;

a removable, opaque housing portion for receiving and storing tokens;

connecting means for aligning and joining said housing portions;

a transverse wall at said connecting means having at least one aperture communicating between said housing portions; and propulsion means for engaging said tokens on said wall and directing said tokens through the aperture into the lower housing portion.

2. The toy bank of claim 1 including drive means for actuating said propulsion means.

3. The toy bank of claim 2 wherein said drive means includes a crank to facilitate manual operation of said drive means.

4. The toy bank of claim 1 wherein said wall is generally concave having the propulsion means mounted generally at the lowermost point thereof.

5. The toy bank of claim 4 wherein said propulsion means includes a rotatably mounted propeller for engaging the tokens and directing the same toward said aperture.

6. The toy bank of claim 5 wherein said drive means includes a gear train for rotating said propeller at a substantially high rate of rotation.

7. The toy bank of claim 1 wherein said connection means in the form of an annular H-shaped ring for securing the upper and lower housing portions together.

8. An amusement device, comprising:

a generally transparent, upper housing portion;

depository means in said upper housing portion for receiving tokens;

a lower housing portion defining a storage compartment for receiving and storing said tokens;

a generally upwardly directed, concave transverse wall between said upper and lower housing portions including at least one aperture therein; and propulsion means for engaging said tokens deposited in the depository means, said propulsion means being mounted generally at the lowermost point of said transverse wall and including a rotatably mounted propeller having a plurality of propeller blades extending upwardly through the transverse wall for engaging tokens and directing the same toward said aperture.

9. The amusement device of claim 8 including drive means for actuating said propulsion means.

10. The amusement device of claim 9 wherein said drive means include a gear train for rotating said propeller at a substantially high rate of rotation.

11. The amusement device of claim 9 wherein said drive means includes a crank to facilitate manual operation of said drive means.

12. The amusement device of claim 8 wherein the lower housing portion is formed of generally opaque material.

13. The amusement device of claim 8 including means for connecting said upper and lower housing portions, said connection means comprising a generally annular connector of H-shaped cross-section.

14. A toy bank, comprising:

a generally transparent, upper housing portion including a slot generally at the top thereof for receiving money, such as coins;

an opaque lower housing portion defining a storage compartment for said money;

a generally transverse wall between the upper and lower housing portions, said transverse wall being generally dish-shaped and having an aperture therein for permitting money to pass therethrough into the lower housing;

propulsion means mounted below said transverse wall and including a rotary element having a plurality of paddles extending upwardly through a second aperture in said transverse wall into the upper housing portion; and manually operable drive means to facilitate rapid rotation of said propulsion means for engaging and directing money through said aperture.

15. The toy bank of claim 14 wherein said drive means includes a gear train for rotating said propeller at a substantially high rate of rotation.

16. The toy bank of claim 14 wherein said drive means includes a crank to facilitate manual operation of said drive means.

17. The toy bank of claim 14 including means for connecting said upper and lower housing portions, said connection means comprising a generally annular connector of H-shaped cross-section.

* * * * *